US005152274A

United States Patent [19]

Maekawa

[11] Patent Number: 5,152,274

[45] Date of Patent: Oct. 6, 1992

[54] IGNITION COIL APPARATUS

[75] Inventor: Toshio Maekawa, Himeji, Japan

[73] Assignee: Mitsubishi Denki Kabushiki Kaisha, Tokyo, Japan

[21] Appl. No.: 737,550

[22] Filed: Jul. 30, 1991

[30] Foreign Application Priority Data

Aug. 1, 1990 [JP] Japan ..... 2-81138[U]
Aug. 2, 1990 [JP] Japan ..... 2-81705[U]
Aug. 2, 1990 [JP] Japan ..... 2-81706[U]

[51] Int. Cl.[5] ..... F02P 3/02
[52] U.S. Cl. ..... 123/635; 123/143 C
[58] Field of Search ..... 123/635, 169 PA, 169 PH, 123/143 C, 647

[56] References Cited

U.S. PATENT DOCUMENTS 4,706,639 11/1987 Boyer et al. ..... 123/635
4,834,056 5/1989 Kawai ..... 123/635
5,109,828 5/1992 Tagami et al. ..... 123/635

FOREIGN PATENT DOCUMENTS 60-190673 9/1985 Japan ..... 123/647

*Primary Examiner*—Andrew M. Dolinar
*Attorney, Agent, or Firm*—Sughrue, Mion, Zinn, Macpeak & Seas

[57] ABSTRACT

An ignition coil apparatus comprises a base plate 10 connectable at its one side to an engine rocker cover. The base plate has a plurality of plug towers 13 for supporting spark plugs 8 and a plurality of ignition coils 18 mounted on the opposite side between the spark plugs so that electrical conductors 19 between the ignition coils and the spark plugs may be short. A cover 21 may be placed on the base plate for covering the ignition coils and the conductors. The base plate, the plug towers, the ignition coils, the conductors and the cover are fastened together as a single ignition coil assembly detachably mounted to the engine as a unit. The rocker cover has plug openings 14 for receiving the spark plugs and a continuous water-proof seal rib 15 is formed on the rocker cover around the plug openings to encircle all of them together. A continuous rib-receiving seal groove 16 is disposed in correspondence with the seal rib to provide a water-tight seal between the rocker cover and the base plate.

2 Claims, 4 Drawing Sheets

IGNITION COIL APPARATUS

BACKGROUND OF THE INVENTION

This invention relates to an ignition coil apparatus for an internal combustion engine having a plurality of spark plugs.

FIG. 7 illustrates a conventional ignition coil apparatus, from which it is seen that four spark plugs #1 to #4 are arranged in a straight line on a rocker cover 2 of a cylinder head of an internal combustion engine. A first ignition coil 3, which is the simultaneous ignition type, is connected through high-tension electrical conductors 5 to the first and the fourth plugs #1 and #4, and a second ignition coil 4, which is the simultaneous ignition type, is connected through high-tension electrical conductors 5 to the second the the third plugs #2 and #3.

High voltage generated in the ignition coils 3 and 4 are applied to the first to the fourth plugs #1 and #4 through the electrical conductors 5.

In the conventional ignition coil apparatus for an internal combustion engine, the relatively long high-tension electrical conductors 5 must extend from the remotely located ignition coils 3 and 4 to the respective plugs #1 to #4 on the engine. Therefore, the generated voltage and the generated energy are decreased due to the resistance and the capacitance of the high-tension electrical conductors 5. Also, since the number of the electrical conductors 5 extending externally of the engine 1 is equal to the number of the spark plugs #1 to #4, the design lay out in the engine compartment is accordingly limited, and the assembly of the installation of the engine is not easy.

Further, as illustrated in FIGS. 8 and 9, the rocker cover 2 of the engine cylinder head has a plurality of ring-shaped ridges or circular seal ribs 6 each formed around plug openings 7 in the rocker cover 2 for receiving the spark plugs therein. Each of the circular seal ribs 6 are engaged by plug caps (not shown) placed over the high-tension electrical conductors 5 in order to establish a water-proof and electrically insulating seal between the conductors 5 and the rocker cover 2.

However, since the waterproof arrangement by the individual plugs caps is provided for each of cylinders or eahc of the spark plugs or the high-tension electrical conductors, the overall structure is complicated and water can stay on the rocker cover to destroy electrical insulation.

SUMMARY OF THE INVENTION

Accordingly, one object of the present invention is to provide an ignition coil apparatus free from the above-discussed problems of the conventional ignition coil apparatus.

Another object of the present invention is to provide an ignition coil apparatus which has very short hightension electrical conductors between the spark plugs and the ignition coils.

Another object of the present invention is to provide an ignition coil apparatus in which the resistance of the high-tension conductors is small.

A further object of the present invention is to provide an ignition coil apparatus which is very simple in structure.

Still another object of the present invention is to provide an ignition coil apparatus which is easy in assembly and installation.

Another object of the present invention is to provide an ignition coil apparatus which is superior in moisture resistivity and electrical insulation.

With the above objects in view, according to the present invention, the ignition coil apparatus for an internal combustion engine having a plurality of spark plugs comprises a plurality of ignition coils mounted on the internal combustion engine between the spark plugs and electrical conductors connected between the ignite coils and the spark plugs.

The ignition coil apparatus for an internal combustion engine may also comprise a base plate connectable at one major surface thereof to the internal combustion engine. The base plate has a plurality of plug towers for supporting the spark plugs and a plurality of ignition coils mounted on the opposite side between the spark plugs so that electrical conductors between the ignition coils and the spark plugs may be short. A cover may be placed on the base plate for covering the ignition coils and the conductors. The base plate, the plug towers, the ignition coils, the conductors and the cover are fastened together as a single ignition coil assembly detachably mounted to the engine as a unit.

The rocker cover of the engine may have plug openings for receiving the spark plugs and a continuous water-proof rib is formed on the rocker cover around the plug openings to encircle all of them together. A continuous rib-receiving groove is disposed in correspondence with the rib to provide a water-tight seal between the rocker cover and the base plate.

BRIEF DESCRIPTION OF THE DRAWINGS

The present invention will become more readily apparent form the following detailed description of the preferred embodiments of the present invention taken in conjunction with the accompanying drawings, in which.

DESCRIPTION OF THE PREFERRED EMBODIMENTS

Figure 1:
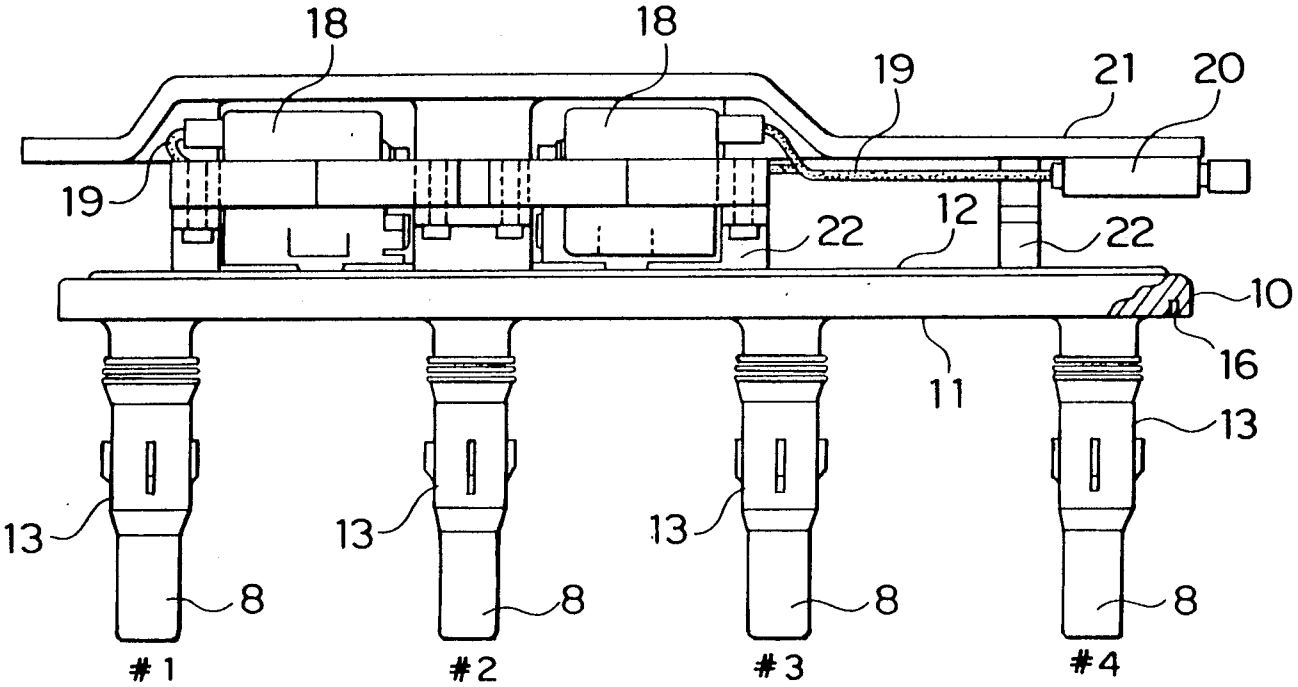
FIG. 1 is side view of the ignition coil apparatus of the present invention.
Figure 2:
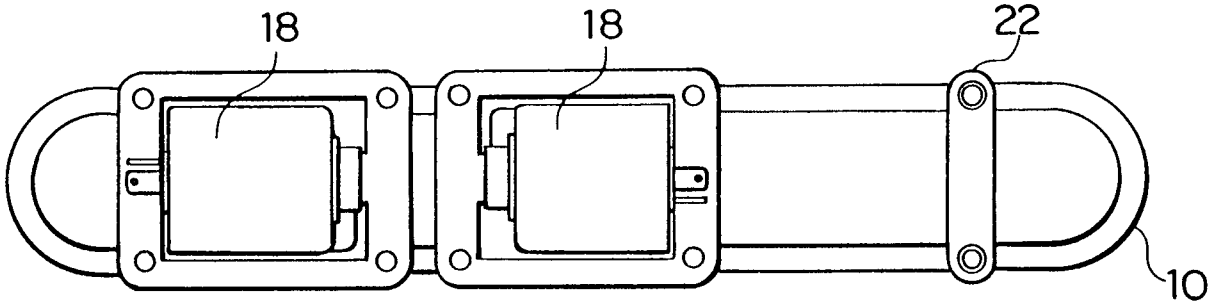
FIG. 2 is a plan view of the ignition coil apparatus illustrated in FIG. 1.
Figure 3:
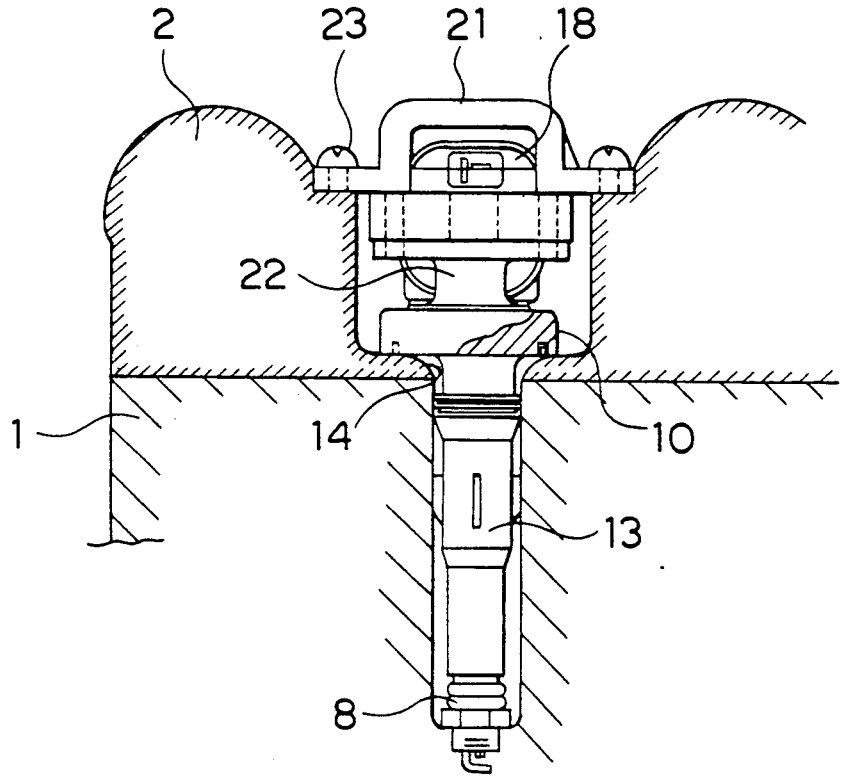
FIG. 3 is a front view of the ignition coil apparatus illustrated in FIG. 1 as attached to an engine cylinder head.
Figure 4:
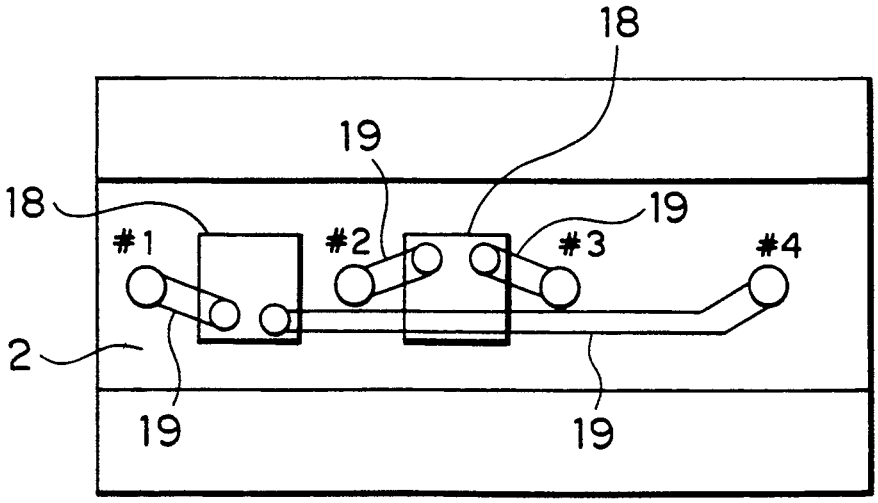
FIG. 4 is a schematic plan view illustrating the general positional relationship between the ignition coils, the spark plugs and the high-tension electrical conductors.

FIGS. 1 to 3 illustrate the ignition coil apparatus of the present invention for a multi-cylinder internal combustion engine having a plurality of spark plugs 8. The ignition coil apparatus comprises an elongated, electrically insulating gas plate 10 having first and second major surfaces 11 and 12, respectively. The first major surface 11 is connectable to the cylinder head 1 of the internal combustion engine and has mounted thereon a plurality of plug towers 13 mounted to the first major surface 11 of the base plate 10. The plug towers 13 are for accommodating and supporting the spark plugs 8 for establishing electrical connections as illustrated in FIG. 3.

Figure 5:
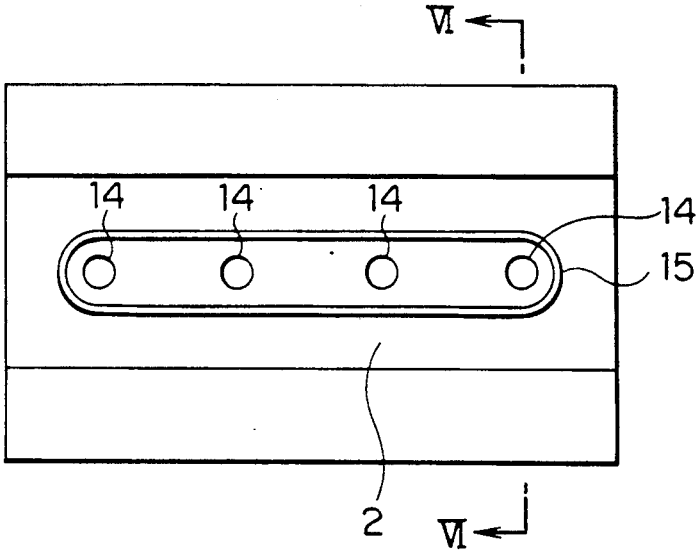
FIG. 5 is a plan view of the rocker cover of the engine illustrating the water resistant seal arrangement of the ignition coil apparatus of the present invention.
Figure 6:
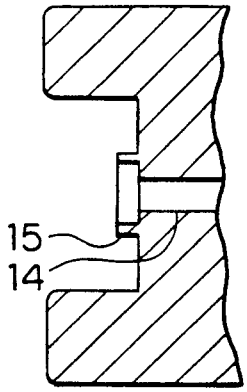
FIG. 6 is a sectional view taken along line VI—VI of FIG. 5 and illustrating the plug openings and the seal rib.
Figure 7:
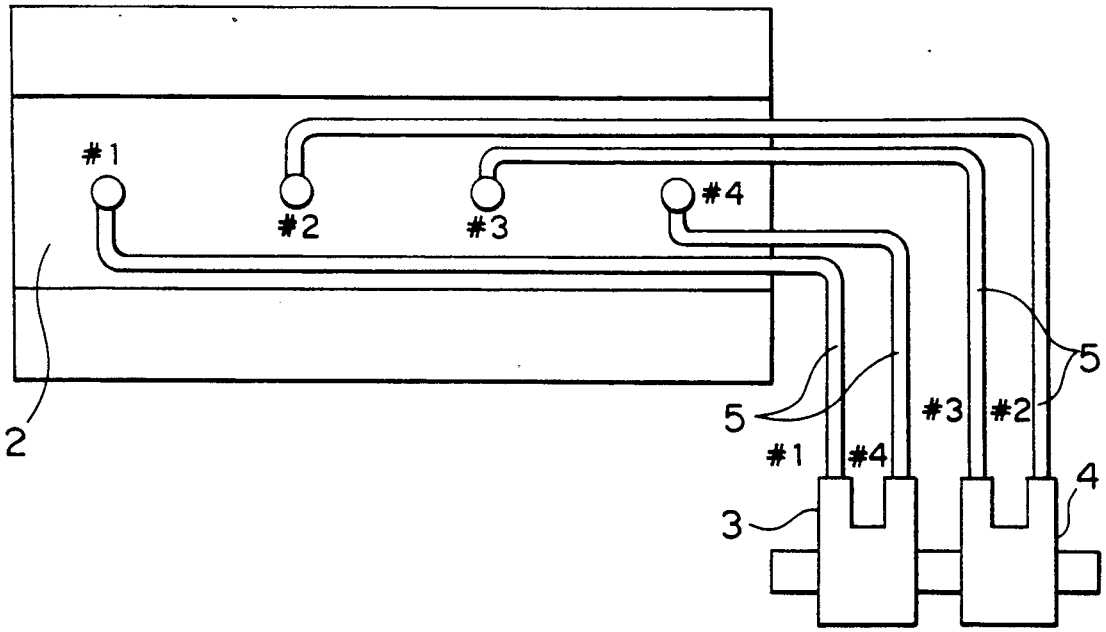
FIG. 7 PRIOR ART
FIG. 7 is a schematic plan view illustrating how the longer high-tension electrical conductors are necessary for connecting the remote ignition coils.
Figure 8:
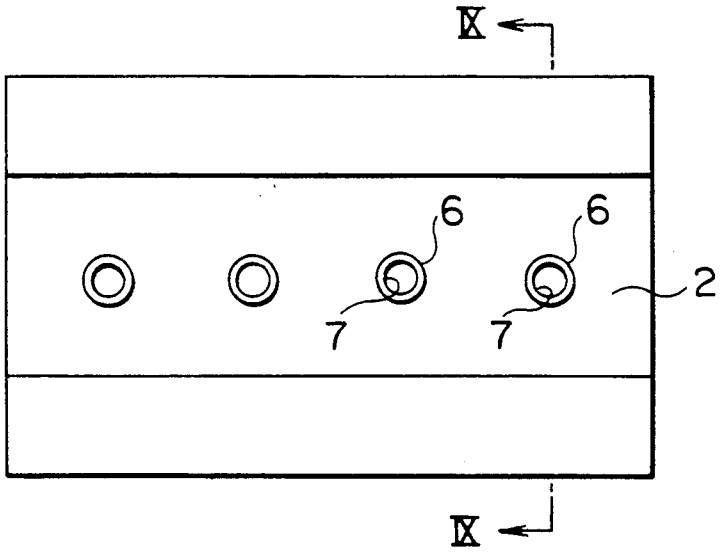
FIG. 8 PRIOR ART
FIG. 8 is a plan view of the rocker cover of the engine illustrating the water resistant seal arrangement of the conventional ignition coil apparatus.
Figure 9:
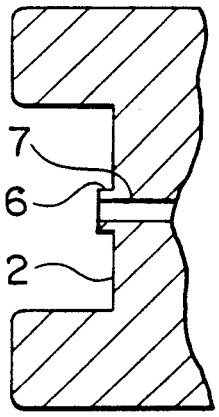
FIG. 9 PRIOR ART
FIG. 9 is a sectional view taken along line IX—IX of FIG. 8.

The base plate 10, when mounted to the internal combustion engine, is placed on the cylinder head 1 with its plug towers 13 inserted into the plug openings 14 as shown in FIG. 3. Also, the rocker cover 2 on the cylinder head 1 has a single continuous, elongated ring-shaped seal rib 15 disposed around the plurality of plug openings 14. It is seen from FIGS. 5 and 6 that the seal rib 15 surrounds the four plug openings 14 together. The bas plate 10 has on the first major surface 11 a single continuous seal groove 16 disposed in correspondence with the seal rib 15 for receiving the seal rib 15 to provide a water-tight seal between the rocker cover 2 and the base plate 10.

From FIGS. 1 to 4, it is also seen that a plurality of ignition coils 18 are mounted on the second major surface 12 of the base plate 10 at positions close to the spark plugs 8. In the illustrated embodiment, the ignition coils 18 are disposed between the spark plugs 8 or the plug openings 14. Therefore, the electrical conductors 19 connected between the ignition coils 18 and the spark plugs 8 can be very short as best seen from FIG. 4. The ignition coil 18 can be connected to an external circuit (not shown) through a switch unit 20 composed of power transistors (not shown) mounted to a cover 21 placed on the base plate 10 through support posts 22 for covering the ignition coils 18 and the conductors 19. Thus, the base plate 10, the plug towers 13, the ignition coils 18, the conductors 19, the switch unit 20 and the cover 21 are all assembled together as a single ignition coil assembly detachably mounted to the engine as a single unit. As seen from FIG. 3, the cover 2 may be secured to the rocker cover 2 and the cylinder head 1 by means of bolts 23.

As has been described, according to the invention coil apparatus of the present invention, the high-tension electrical conductors connecting the ignition coils to the spark plugs are very short as compared to the conductors of the conventional design. Therefore, the generated voltage and the generated energy are not disadvantageously affected due to the resistance and the capacitance of the high-tension electrical conductors. Also, since no high tension electrical conductors extend externally of the engine, the degree of freedom of the design layout in the engine compartment is very large.

Also, since the base plate, the plug towers, the ignition coils, the conductors and the cover are fastened together as a single ignition coil assembly detachably mounted to the engine as a single unit, the assembly or the installation of the ignition coil apparatus on the engine is very simple and easy. Also, the structure of the ignition coil apparatus is simple and compact.

Further, a single water-proof seal rib is disposed on the rocker cover around the plurality of plug openings to surround them together, and a single water-proof seal groove is disposed in correspondence with the seal rib for receiving the rib to provide a water-tight seal between the rocker cover and the base plate. Therefore the ignition coil apparatus of the present invention is superior in moisture resistivity and electrical insulation.

What is claimed is:

1. An ignitor coil apparatus for an internal combustion engine having a plurality of spark plugs, comprising:

a rocker cover attached to the internal combustion engine and having a plurality of plugs openings for receiving said spark plugs therein;

a single continuous water-proof seal rib disposed on said rocker cover around said plurality of plug openings to surround them together;

a base plate having a first and a second major surface, said base plate being connectable at said first major surface thereto to said rocker cover;

a single continuous water-proof seal groove disposed in correspondence with said seal rib for receiving said seal rib to provide a water-tight seal between said rocker cover and said base plate;

a plurality of ignition coils mounted on said base plate on said second major surface thereof at positions close to said plug openings having spark plugs therein;

electrical conductors connected between said ignition coils and said spark plugs and for external connection; and a cover placed on said base plate for covering said ignition coils and said conductors;

said base plate, said plug towers, said ignition coils, said conductors and said cover being fastened together as a single ignition coil assembly detachably mounted to the engine as a single unit.

2. An ignition coil apparatus as claimed in claim 1, wherein said ignition coils are mounted between said spark plugs.

* * * * *